US010337818B1

(12) United States Patent
Sampson, Jr.

(10) Patent No.: US 10,337,818 B1
(45) Date of Patent: Jul. 2, 2019

(54) AK-47 TRIGGER ASSEMBLY

(71) Applicant: John Burton Sampson, Jr., Chandler, AZ (US)

(72) Inventor: John Burton Sampson, Jr., Chandler, AZ (US)

( * ) Notice: Subject to any disclaimer, the term of this patent is extended or adjusted under 35 U.S.C. 154(b) by 18 days.

(21) Appl. No.: 15/904,518

(22) Filed: Feb. 26, 2018

(51) Int. Cl.

| | |
|---|---|
| ***F41A 19/33*** | (2006.01) |
| ***F41A 19/16*** | (2006.01) |
| ***F41A 3/66*** | (2006.01) |
| ***F41A 19/12*** | (2006.01) |
| ***F41A 19/24*** | (2006.01) |
| ***F41A 19/10*** | (2006.01) |
| *F41A 17/46* | (2006.01) |

(52) U.S. Cl.
CPC ..... *F41A 19/16* (2013.01); *F41A 3/66* (2013.01); *F41A 19/10* (2013.01); *F41A 19/12* (2013.01); *F41A 19/24* (2013.01); *F41A 19/33* (2013.01); *F41A 17/46* (2013.01)

(58) Field of Classification Search
None
See application file for complete search history.

(56) References Cited

U.S. PATENT DOCUMENTS 5,623,114 A * 4/1997 Soper ..... F41A 19/46 89/141
8,667,881 B1 * 3/2014 Hawbaker ..... F41A 19/46 42/69.01

FOREIGN PATENT DOCUMENTS

CA 2558836 A1 * 3/2007 ..... F41A 19/46

* cited by examiner

*Primary Examiner* — Stephen Johnson
(74) *Attorney, Agent, or Firm* — Parsons & Goltry; Robert Parsons; Michael Goltry

(57) ABSTRACT

A modification to a trigger assembly for an AK style firearm having a trigger with sear and a disconnector pivotally coupled to the trigger, includes a secondary disconnector pivotally coupled to the trigger rearward of the disconnector and movable between a limiting position toward the disconnector and a non-limiting position away from the disconnector. A selector bar is movable between a front position, engaging the trigger to prevent rotation thereof, a middle position allowing the secondary disconnector to be biased into the limiting position engaging the disconnector, and a back position engaging the secondary disconnector and retaining the secondary disconnector in the non-limiting position against the bias and spaced from the disconnector.

12 Claims, 7 Drawing Sheets

AK-47 TRIGGER ASSEMBLY

FIELD OF THE INVENTION

This invention relates to AK-47 accessories.

More particularly, the present invention relates to trigger assemblies for AK-47 firearms.

BACKGROUND OF THE INVENTION

In the field of firearms, many modifications are made to firearm systems to increase effectiveness. In particular, various semi-automatic firearm platforms like the AR-15, the AK-47 and the like have many accessories and upgrades which can be used to replace stock parts. Some of these replacement parts are employed to improve firing rates of semi-automatic weapons. Automatic firearms fire multiple rounds and continuously cycle through a firing sequence as long as the trigger is pulled to the release (firing) position. Semi-automatic firearms only fire a single round and cycle through a firing sequence with each trigger pull. Automatic weapons are limited in both quantity and accessibility, due to restrictions placed on them. As a result, many devices have been proposed in the past for increasing the firing rate of semi-automatic firearms.

Some of these solutions attempt to make it easier to "bump fire", or use the firearms recoil to allow user to manipulate the trigger at a greater rate. Many of these devices fail to meet the needs of the industry because of overcomplicated mechanisms, reductions in accuracy and the like. Other devices alter elements of the trigger mechanism such as the sear. While somewhat effective, these devices alter the firing rate without allowing the alteration to be selected or de-selected. In other words, the entire alteration mechanism must be installed and removed to switch between modes of operation.

It would be highly advantageous, therefore, to remedy the foregoing and other deficiencies inherent in the prior art.

An object of the present invention is to provide a trigger assembly having a selectable double fire mode.

SUMMARY OF THE INVENTION

Briefly, to achieve the desired objects and advantages of the instant invention provided is a modification to a trigger assembly for an AK style firearm. The AK style firearm includes a trigger with sear and a disconnector pivotally coupled to the trigger. The modification includes a secondary disconnector pivotally coupled to the trigger rearward of the disconnector and movable between a limiting position toward the disconnector and a non-limiting position away from the disconnector. The secondary disconnector is biased toward the limiting position. A selector bar is movable between a front position, engaging the trigger to prevent rotation thereof, a middle position allowing the secondary disconnector to be biased into the limiting position engaging the disconnector, and a back position engaging the secondary disconnector and retaining the secondary disconnector in the non-limiting position against the bias and spaced from the disconnector.

Also provided is a trigger assembly for a firearm with a hammer having a catch face and movable between a cocked position and a firing position. The trigger assembly includes a trigger with a sear formed at a forward portion thereof and a rearward portion. The trigger is movable between a release position and an engage position and biased to the engage position. A disconnector with a hook portion for engaging the catch face of the hammer is pivotally carried by the trigger and movable between a forward position, a limited forward position, and a rearward position, and biased toward the forward position. A secondary disconnector is movable between a limited position and a non-limited position and biased to the limited position. The secondary disconnector when in the limited position prevents the disconnector from being biased to the forward position, limiting the disconnector to the limited forward position.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENTS

Figure 1:
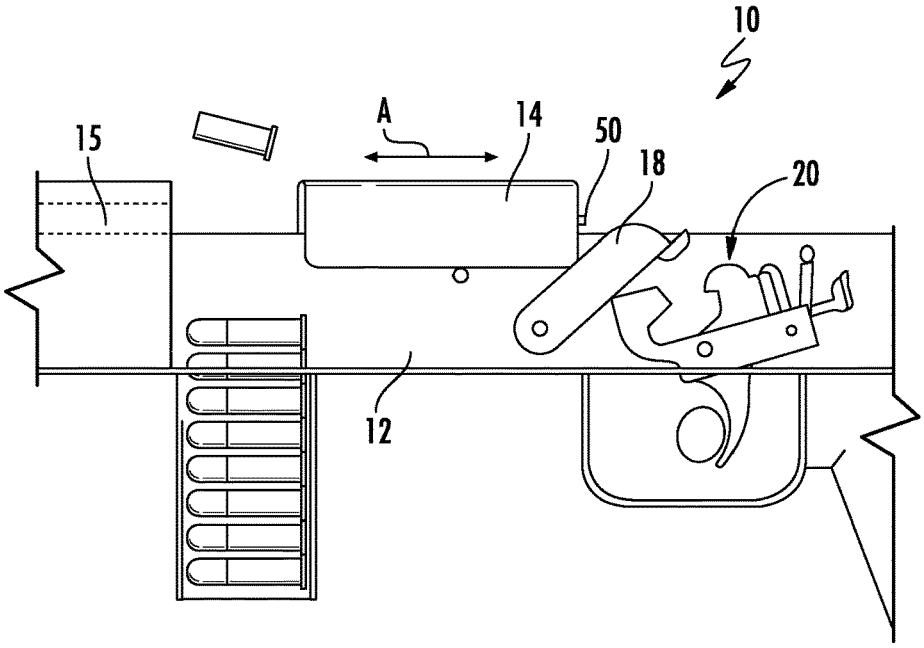
FIG. 1 is a simplified diagrammatic side view of a portion of firearm with the trigger assembly of the present invention.

Turning now to the drawings in which like reference characters indicate corresponding elements throughout the several views, attention is first directed to FIG. 1 which is a schematized portion of a semi-automatic firearm, generally designated 10. Semi-automatic firearm 10 is preferably an AK style firearm such as but not limited to AK-47 rifles, and the like. Firearm 10 includes a receiver 12, a bolt carrier 14 reciprocally movable within receiver 12 as indicated by double arrowed line A, between a forward position toward a barrel 15 and a rearward position away from barrel 15. It will be understood that a forward and a rearward direction used throughout the description indicates a direction toward the muzzle end of a firearm and a direction toward the butt end of a firearm, respectively. Moving toward the rearward position during a firing cycle, bolt carrier 14 engages a hammer 18 and drives it rearwardly against a spring bias. This process (firing cycle) and these elements are well known to those skilled in the art, and will not be described in detail.

Figure 2:
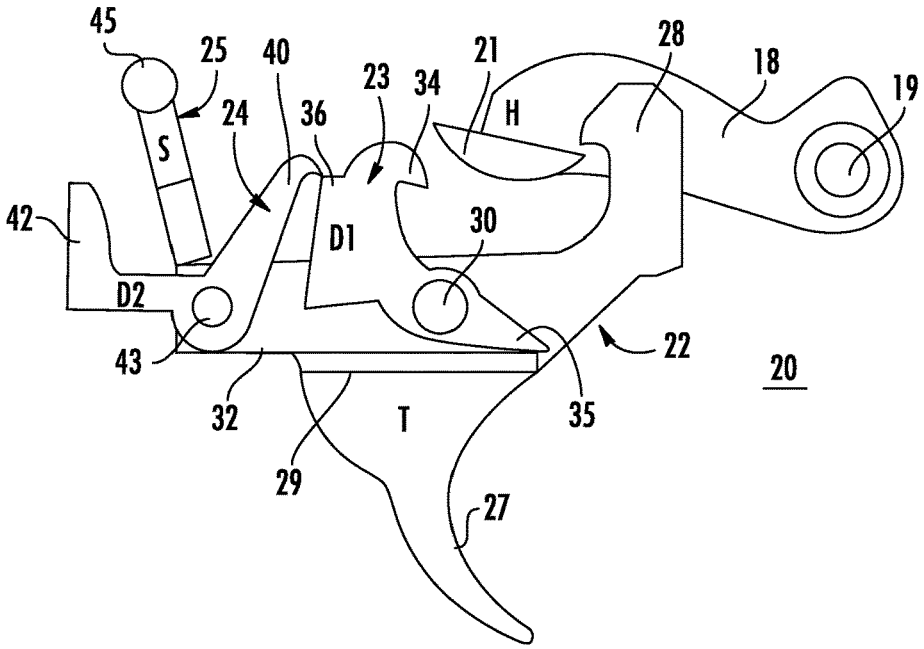
FIG. 2 is a side view of a trigger assembly according to the present invention as it appears in a safe mode.

With additional reference to FIG. 2, firearm 10 includes a trigger assembly 20, used to retain and release hammer 18 by engaging a catch face 21 of hammer 18. Hammer 18 is pivotally coupled to receiver 12 by a pin 19 and movable between a firing position and a cocked position. Trigger assembly 20 includes a trigger 22, a disconnector 23 a secondary disconnector 24 and a selector bar 25. Trigger 22 includes a finger grip 27, a sear 28 formed at a forward portion thereof, and a mounting plate 29 bisecting trigger 22 between finger grip 27 and sear 28. Trigger 22 is pivotally coupled to receiver 12 by a pin 30 extending therethrough above mounting plate 29, and movable between a release position and an engage position. Trigger 22 is biased by a spring (not shown) in a counter-clockwise direction about pin 30 with respect to FIG. 2, to the engaged position by a spring member. Moving trigger 22 counter-clockwise to the engaged position moves sear 28 upwardly and rearwardly, and concurrently moves a rearward portion 32 of trigger 22 downwardly and rearwardly. Disconnector 23 includes a hook portion 34 extending upwardly and directed in a forward direction, a plate engaging portion 35 extending downwardly for engagement with mounting plate 29, and a notch 36 rearward of hook portion 34. Disconnector 23 is pivotally mounted on pin 30 adjacent trigger 22 and movable between a forward position, a limited forward position, and a rearward position. Pin 30 extends through disconnector 23 intermediate hook portion 34 and plate engaging portion 35, with plate engaging portion 35 abutting mounting plate 29. Disconnector 23 is biased by a spring member (not shown) in a clock-wise direction into the forward position with hook portion 34 moved forwardly until plate engaging portion 35 contacts mounting plate 29. Secondary disconnector 24 includes a hook portion 40 extending upwardly and directed in a forward direction and a contact member 42 extending rearwardly. Secondary disconnector 24 is pivotally mounted on rearward portion 32 of trigger 22 by a pin 43 and movable between a limiting position and a non-limiting position. Pin 43 extends through secondary disconnector 24 intermediate hook portion 40 and contact member 42. Secondary Disconnector 24 is biased by a spring member (not shown) in a clock-wise direction into the limiting position with hook portion 34 moved forwardly until it engages and rides against the rearward portion of disconnector 23. Selector bar 25 is pivotally coupled to receiver 12 by a pin. Selector bar 25 is movable between a back position, placing firearm 10 into a semi-automatic fire mode, a middle position placing firearm 10 in a double fire mode, and a front position, placing firearm 10 in a safe mode.

As can be seen, trigger assembly 20 includes a conventional trigger group that has been modified by incorporation of secondary disconnector 24. In the preferred embodiment, the trigger group modified is the Tapco G2 trigger group. It will be understood by one skilled in the art that this modification can be made to other existing trigger groups used on AK style firearm platforms and the like. It will also be understood that while modification to existing triggers groups can be performed, dedicated trigger assemblies according to the present invention can also be provided to fully replace existing trigger groups.

Turning to FIGS. 2-13, various positions of the elements of trigger assembly 20 are illustrated in the different modes and during different points of time in the firing cycle of firearm 10. FIG. 2 illustrates trigger assembly 20 with firearm 10 in the safe mode. In this mode, selector bar 25 is in the front position, engaging rearward portion 32 of trigger 22, preventing movement thereof from the engaged position to the release position. In this position, hammer 18 is retained in the cocked position by sear 28 engaging catch face 21.

Figure 3:
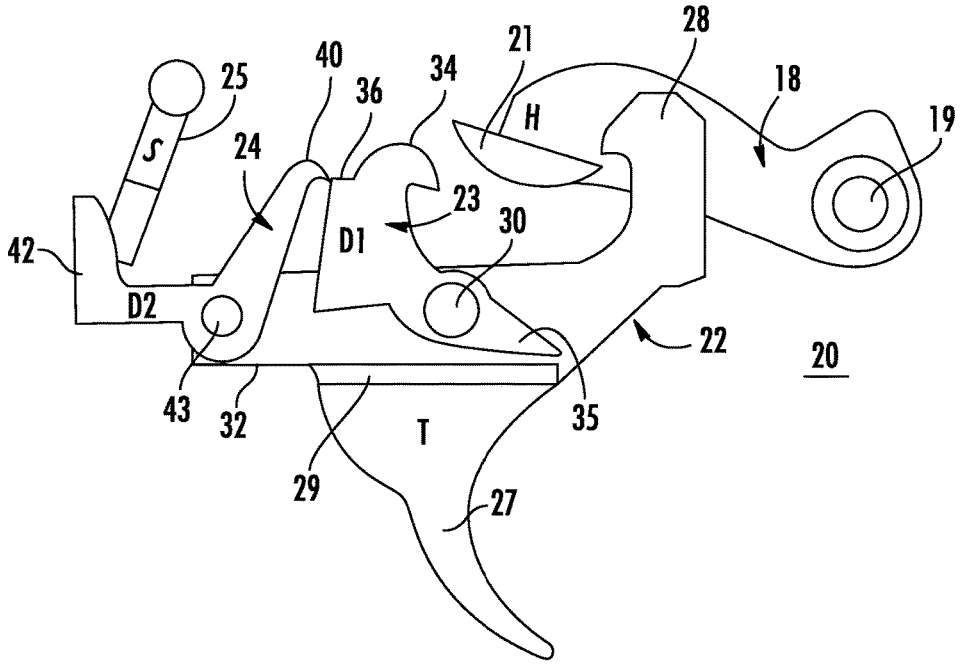
FIG. 3 is a side view of the trigger assembly according to the present invention as it appears in a semi-automatic firing mode.
Figure 4:
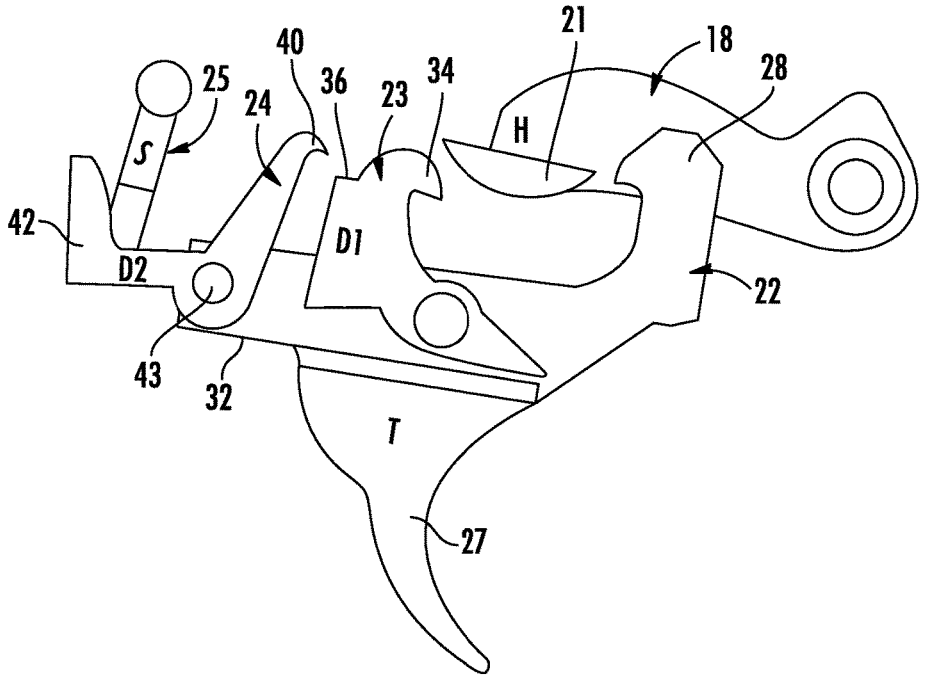
FIGS. 4-6 are each a side view of the trigger assembly according to the present invention as it appears at different times during a firing cycle in semi-automatic firing mode.
Figure 5:
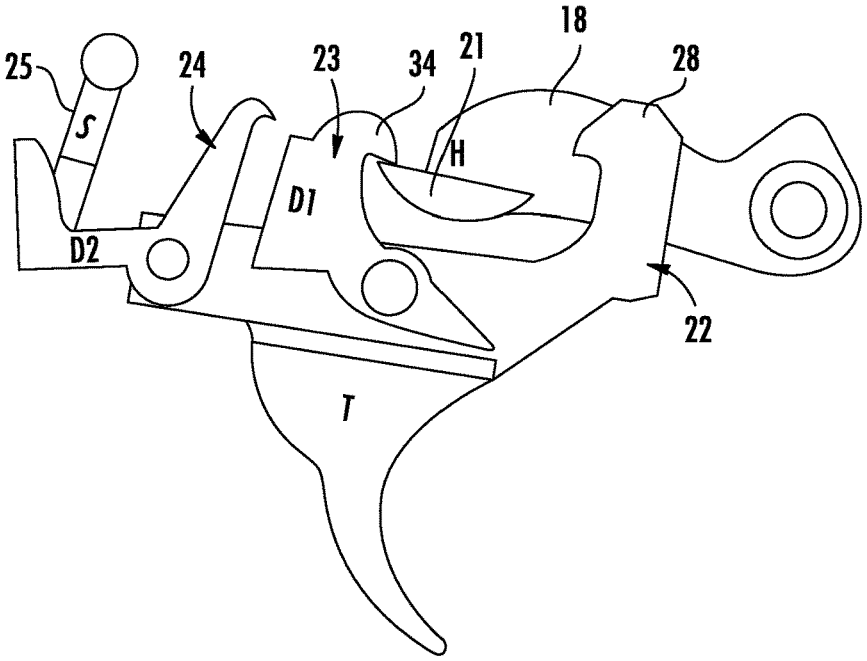
Figure 6:
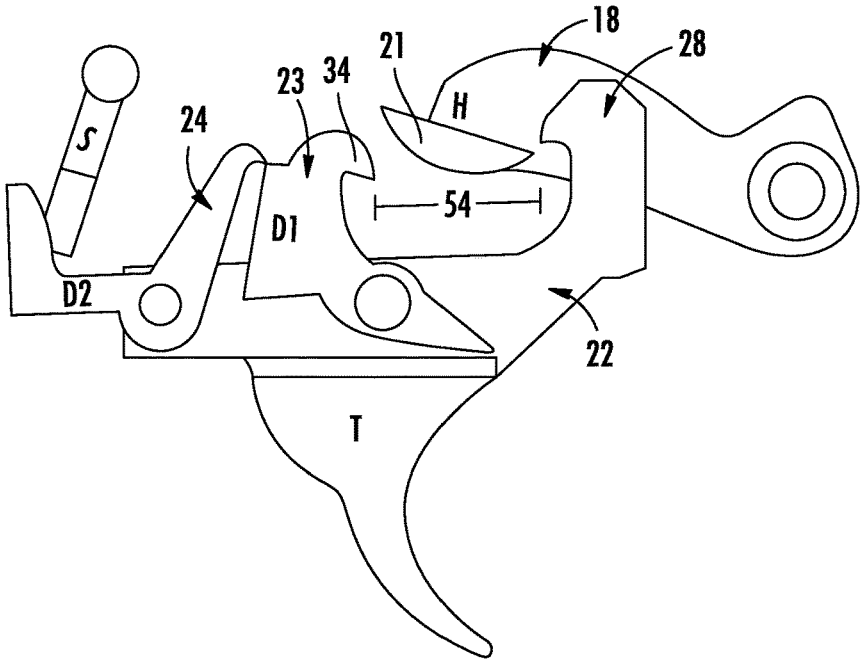

Referring now to FIGS. 3-6, trigger assembly 20 is illustrated with firearm 10 in the semi-automatic mode. In the semi-automatic mode, selector bar 25 is moved to the back position forcing secondary disconnector 24 to pivot counter-clockwise against the spring bias to the non-limiting position. In the non-limiting position, secondary disconnector 24 does not engage disconnector 23 and allows disconnector 23 to operate in a conventional manner, biased to the forward position. FIG. 3 illustrates trigger assembly 20 retaining hammer 18 in the cocked position. FIG. 4 illustrates trigger assembly 20 when trigger 22 is rotated in a clockwise direction against the spring bias, releasing hammer 18. Hammer 18 rotates up, strikes a firing pin 50 carried by bolt carrier 14 and ignites a round. When a round is fired, bolt carrier 14 is pushed rearwardly, which in turn, pushes hammer 18 rearwardly against the spring bias until it engages and is caught by hook portion 34 of disconnector 23 as shown in FIG. 5. Bolt carrier 14 completes its rearward travel and moves forward under spring tension. Bolt carrier 14 strips another round from a magazine 52 and loads it into a firing chamber, ready to be fired. When trigger 22 is released, trigger 22 is rotated in a counter-clockwise direction by spring bias resulting in hook portion 34 of disconnector 23 releasing hammer 18 which is then caught and held by sear 28 of trigger 22, completing the firing cycle. In the semi-automatic mode, a gap 54 between hook portion 34 of disconnector 23 in the forward position and sear 28 is smaller than the width of catch face 21 of hammer 18. This results in sear 28 overlapping hammer 18 when disconnector 23 (in the forward position) is holding hammer 18. Hammer 18 cannot slip past sear 28 when trigger 22 is released, preventing firing.

Figure 7:
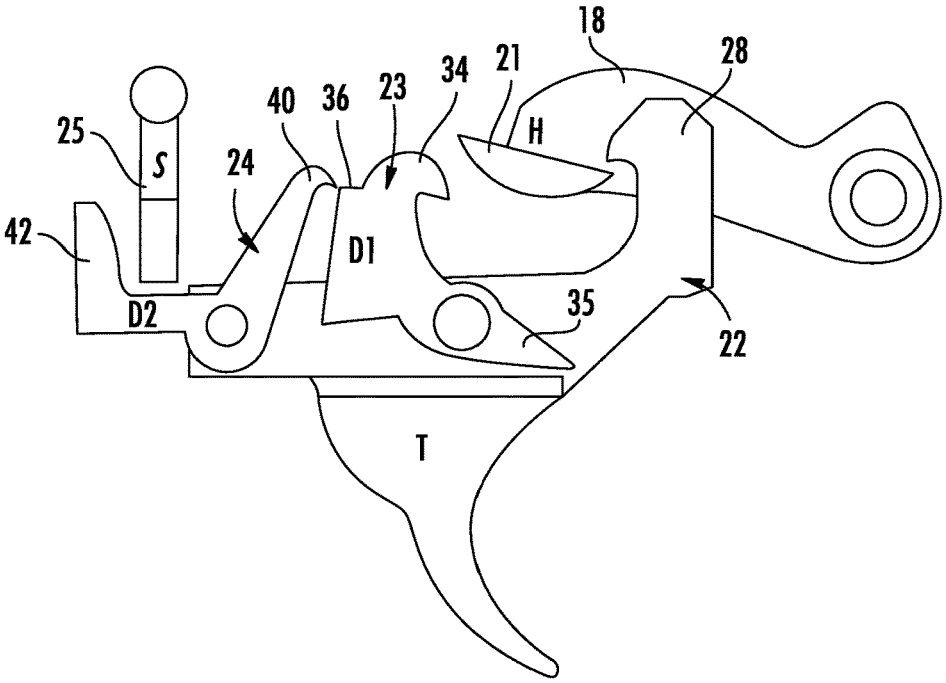
FIG. 7 is a side view of the trigger assembly according to the present invention as it appears in a double firing mode.
Figure 8:
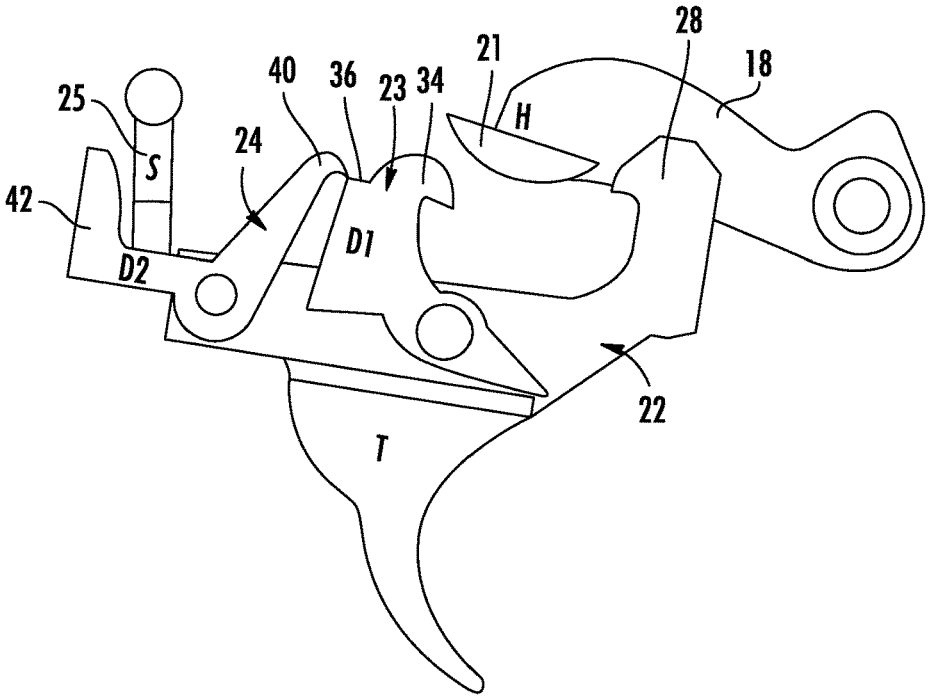
FIG. 8-12 are each a side view of the trigger assembly according to the present invention as it appears at different times during a firing cycle in double firing mode.
Figure 9:
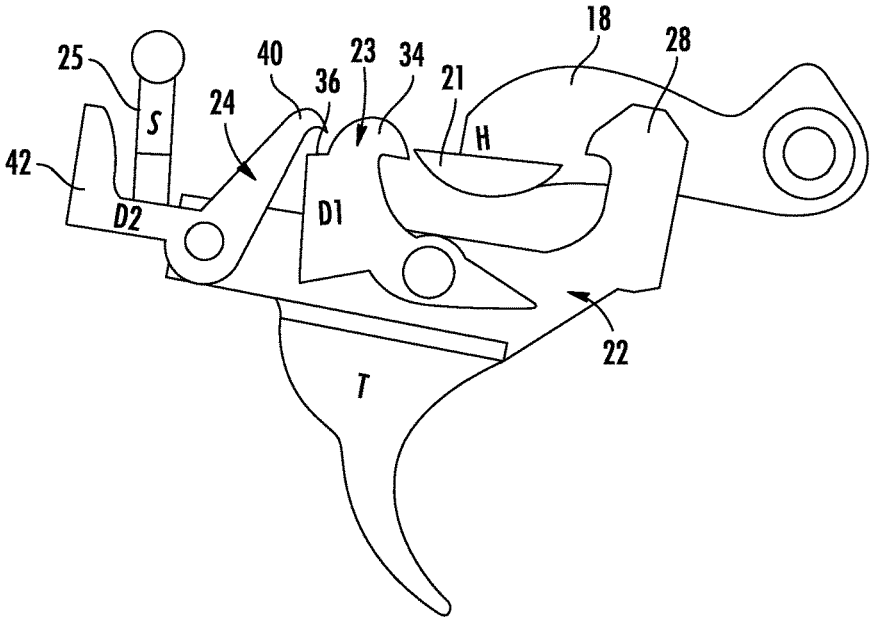
Figure 10:
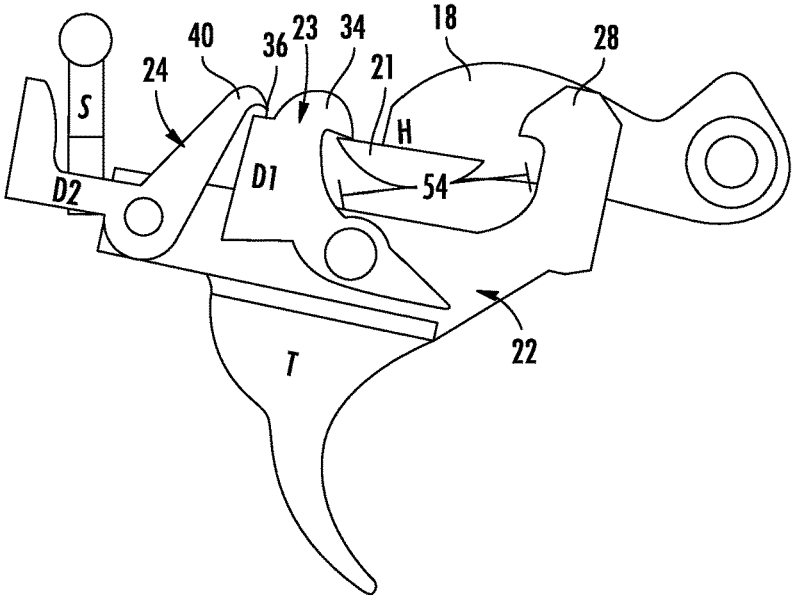

Referring now to FIGS. 7-12, trigger assembly 20 is illustrated with firearm 10 in the double fire mode. In the double fire mode, selector bar 25 is moved to the middle position, releasing secondary disconnector 24 to pivot clockwise with the spring bias to the limiting position. In the limiting position, secondary disconnector 24 rides against the back of disconnector 23. FIG. 7 illustrates trigger assembly 20 with sear 28 retaining hammer 18 in the cocked position. FIG. 8 illustrates trigger assembly 20 when trigger 22 is rotated in a clockwise direction against the spring bias, releasing hammer 18. Hammer 18 rotates up, strikes firing pin 50 carried by bolt carrier 14 and ignites a round. When a round is fired, bolt carrier 14 is pushed rearwardly, which in turn, pushes hammer 18 rearwardly against the spring bias. In the double fire mode, bolt carrier 14 pushes hammer 18 into disconnector 23 and pushes disconnector 23 rearwardly so that hammer 18 can slip by hook portion 34 as seen in FIG. 9. As disconnector 23 is rotated in the counter-clockwise direction, secondary disconnector 24 is biased forwardly and engages notch 36 of disconnector 23 as seen in FIG. 10. With secondary disconnector 24 in the limiting position, it engages and prevents disconnector 23 from being biased forwardly into the forward position, limiting disconnector 23 to the limited forward position. In other words, after hammer 18 has been moved rearwardly and disconnector 23 moves forward to engage catch face 21, hook portion 40 of secondary disconnector 24 has engaged notch 36 of disconnector 23, preventing disconnector 23 from moving as far forward as it normally would but still allowing it to capture hammer 18.

Figure 11:
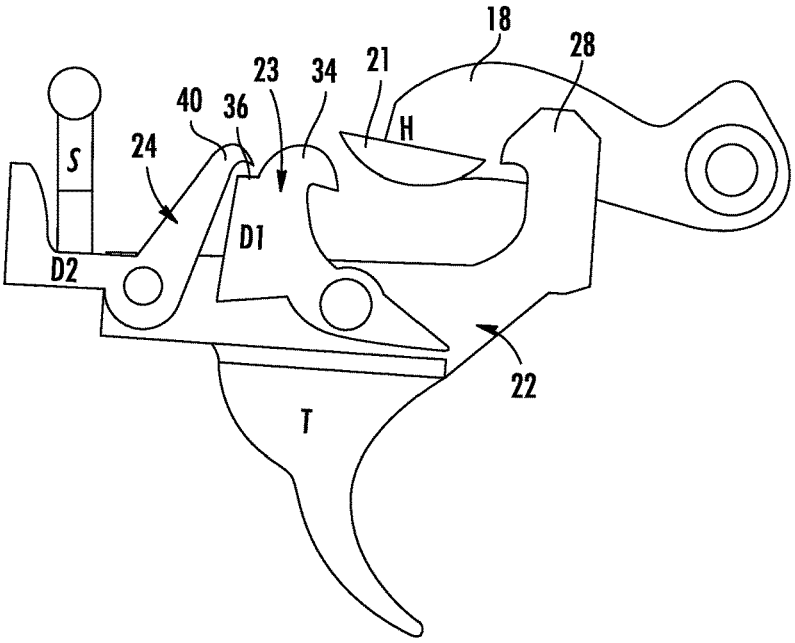
Figure 12:
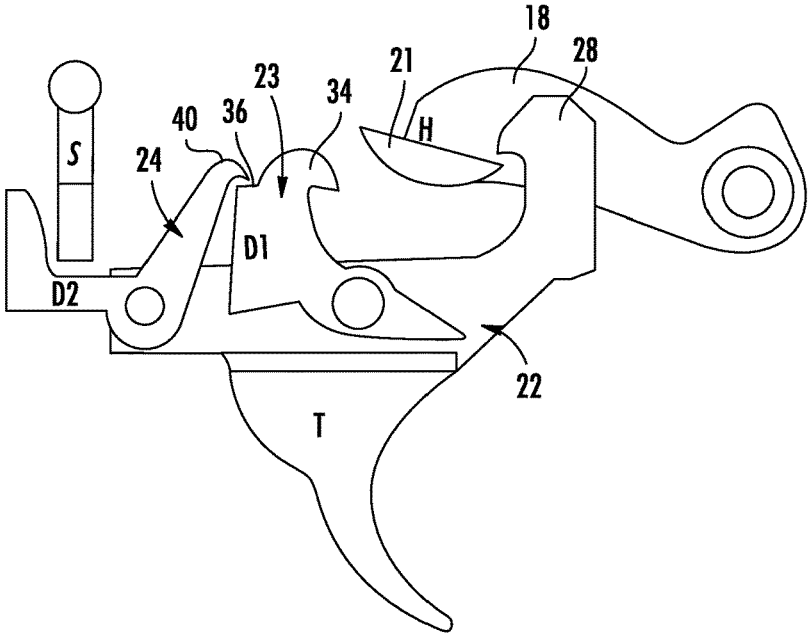

Still referring to FIG. 10, with disconnector 23 held in the limited forward position, farther back by secondary disconnector 24 than it normally would be, gap 54 between sear 28 and hook portion 34 of disconnector 23 is wider than catch face 21. Thus, when trigger 22 is released allowing the spring bias to rotate trigger 22 in the counter-clockwise direction, hammer 18 has enough room to slip past sear 28 and ignite a round as seen in FIG. 11. When hammer 18 is pushed back by bolt carrier 14 as the firing cycle continues, hammer 18 is caught by sear 28 which is now in the engaged position as seen in FIG. 12. This completes the double firing cycle.

Figure 13:
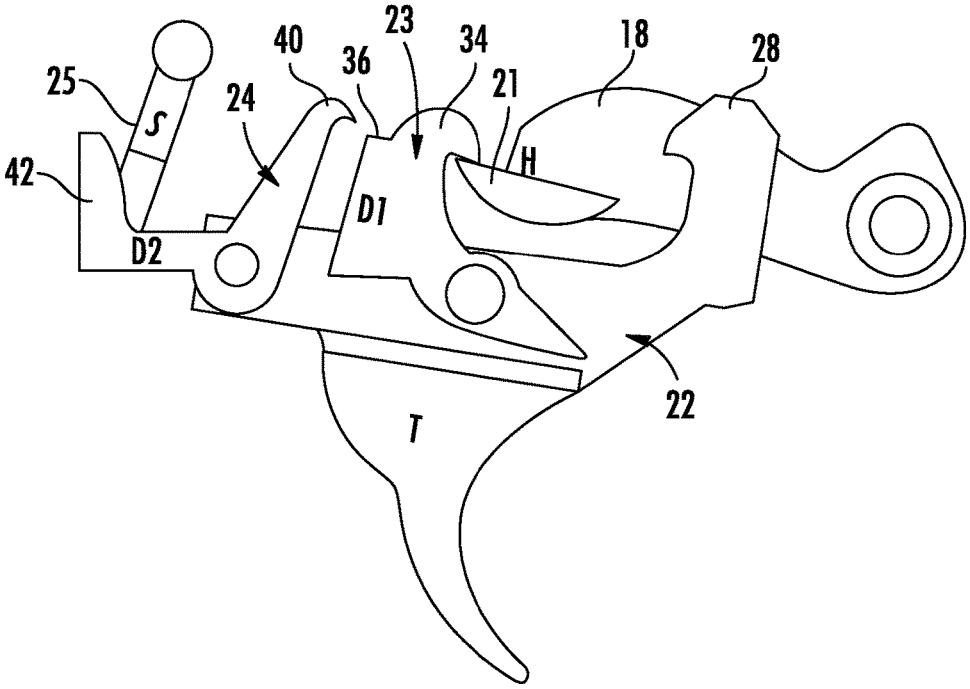
FIG. 13 is a side view of the trigger assembly according to the present invention as it appears with the trigger pulled and the selector set to safe mode.

In double fire mode once trigger 22 is pulled, moving trigger 22 to the release position, initiating the firing cycle and firing a round, trigger 22 is held in the release position with another round ready to be fired on release of trigger 22. Double fire mode can be safely canceled before firing the second round if selector bar 25 is moved to the back position to place firearm 10 in the semi-automatic mode. This causes selector bar 25 to engage rearward portion 42 of secondary disconnector 24 and release disconnector 23 to its normal forward position as shown in FIG. 13. Trigger 22 can then be released and a round will not be fired.

It will be understood by those skilled in the art that in other firearms employing double fire mechanisms, if the trigger is released too fast after the first round is fired, the hammer can slip past the hooks and follow the bolt carrier back and ride on the firing pin. While not always a problem, the potential is there to fire another round. In trigger assembly 20 of the present invention, by limiting gap 54 between disconnector 23 and sear 28, hammer 18 is prevented from following the bolt carrier 14. If the trigger is release too fast hammer 18 will be unable to pass through gap 54 and will get caught by sear 28. This negates the round being fired on releasing the trigger but all that is required is to pull the trigger as normal and the cycle is started again. Thus, trigger control is required, but unintentional firing is prevented.

Thus, a firearm 10 is provided which has a selectable fire mode that will allow selection of safe mode to prevent any firing, a semi-automatic mode which fires a round on each trigger pull, and a double fire mode wherein a round is fired upon trigger pull and another round is fired upon releasing the trigger.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A modification to a trigger assembly for a firearm having a trigger with sear and a disconnector pivotally coupled to the trigger, the modification comprising:

a secondary disconnector pivotally coupled to the trigger rearward of the disconnector and movable between a limiting position toward the disconnector wherein the secondary disconnector engages the disconnector and reduces forward movement thereof, and a non-limiting position away from the disconnector wherein the secondary disconnector is spaced from the disconnector and allows forward movement thereof, the secondary disconnector biased towards the limiting position; and a selector bar movable between a front position, engaging the trigger to prevent rotation thereof, a middle position allowing the secondary disconnector to be biased into the limiting position engaging the disconnector, and a back position engaging the secondary disconnector and retaining the secondary disconnector in the non-limiting position and spaced from the disconnector.

2. The modification as claimed in claim 1 wherein the secondary disconnector includes a hook portion which, in the limiting position, engages the disconnector and reduces the forward movement thereof.

3. The modification as claimed in claim 2 wherein the secondary disconnector includes a contact member extending rearwardly from the hook portion to a position rearward of the selection bar, the selection bar contacting the contact member when the selection bar is in the back position, retaining the secondary disconnector in the non-limiting position.

4. A trigger assembly for a firearm with a hammer having a catch face and movable between a cocked position and a firing position, the trigger assembly comprising:

a trigger including a sear formed at a forward portion thereof and a rearward portion, the trigger movable between a release position and an engage position and biased to the engage position;

a disconnector with a hook portion for engaging the catch face of the hammer, the disconnector pivotally carried by the trigger and movable between a forward position, a limited forward position, and a rearward position, and biased toward the forward position;

a secondary disconnector movable between a limiting position and a non-limiting position and biased to the limiting position; and the secondary disconnector when in the limiting position engaging the disconnector and preventing the disconnector from being biased to the forward position, limiting the disconnector to the limited forward position.

5. The trigger assembly for a firearm as claimed in claim 4 further including a selector bar movable between a front position, engaging the trigger to prevent rotation thereof, a middle position allowing the secondary disconnector to be biased into the limiting position engaging the disconnector, and a back position engaging the secondary disconnector and retaining the secondary disconnector in the non-limiting position and spaced from the disconnector.

6. The trigger assembly for a firearm as claimed in claim 5 wherein the secondary disconnector includes a hook portion which, in the limiting position, engages the disconnector and reduces the forward movement thereof to the limited forward position.

7. The trigger assembly for a firearm as claimed in claim 6 wherein the secondary disconnector includes a contact member extending rearwardly from the hook portion to a position rearward of the selection bar, the selection bar contacting the contact member when the selection bar is in the back position, retaining the secondary disconnector in the non-limiting position.

8. The trigger assembly for a firearm as claimed in claim 4 wherein the hook portion of the disconnector and the sear have a gap therebetween, the gap is smaller than a width of the catch face with the disconnector in the forward position and the gap is larger than the width of the catch face with the disconnector in the limited forward position.

9. A firearm comprising:

a receiver;

a hammer carried by the receiver, the hammer having a catch face and movable between a cocked position and a firing position;

a trigger carried by the receiver adjacent the hammer, the trigger including a sear formed at a forward portion thereof and a rearward portion, the trigger movable between a release position and an engage position and biased to the engage position;

a disconnector with a hook portion for engaging the catch face of the hammer, the disconnector pivotally carried by the trigger and movable between a forward position, a limited forward position, and a rearward position, and biased toward the forward position;

a secondary disconnector movable between a limiting position and a non-limiting position and biased to the limiting position; and the secondary disconnector when in the limiting position engaging the disconnector and preventing the disconnector from being biased to the forward position, limiting the disconnector to the limited forward position.

10. A trigger assembly for a firearm as claimed in claim 9 further including a selector bar movable between a front position, engaging the trigger to prevent rotation thereof, a middle position allowing the secondary disconnector to be biased into the limiting position engaging the disconnector, and a back position engaging the secondary disconnector and retaining the secondary disconnector in the non-limiting position against the bias and spaced from the disconnector.

11. The trigger assembly as claimed in claim 10 wherein the secondary disconnector includes a hook portion which, in the limiting position, engages the disconnector and reduces the forward movement thereof to the limited forward position.

12. The trigger assembly as claimed in claim 11 wherein the secondary disconnector includes a contact member extending rearwardly from the hook portion to a position rearward of the selection bar, the selection bar contacting the contact portion when the selection bar is in the back position, retaining the secondary disconnector in the non-limiting position.

* * * * *